United States Patent [19]

Mitter

[11] 4,098,186

[45] Jul. 4, 1978

[54] SCREEN PRINTING MACHINE WITH ADJUSTABLE END-MOUNTING UNITS

[76] Inventor: Mathias Mitter, Sandweg 11, 4831 Verl-Sende Mitte, Germany

[21] Appl. No.: 700,206

[22] Filed: Jun. 28, 1976

Related U.S. Application Data

[63] Continuation of Ser. No. 458,342, Apr. 5, 1974, Pat. No. 3,995,552.

[51] Int. Cl.[2] ..... B41F 15/08; B41F 15/38

[52] U.S. Cl. ..... 101/127.1; 101/122; 101/128.1

[58] Field of Search ..... 101/122, 127.1, 128.1, 101/216; 198/806, 807

[56] References Cited

U.S. PATENT DOCUMENTS

| | | | |
|---|---|---|---|
| 2,019,375 | 10/1935 | Wheelwright | 101/122 X |
| 2,054,152 | 9/1936 | Wood | 101/122 |
| 2,451,394 | 10/1948 | Klein | 198/806 |
| 2,762,295 | 9/1956 | Varga et al. | 101/216 X |
| 2,851,947 | 9/1958 | McCormick | 101/122 |
| 3,101,005 | 8/1963 | Mittag | 198/807 X |
| 3,193,086 | 7/1965 | Wilhelm | 198/807 |
| 3,698,540 | 10/1972 | Jordan | 198/806 |
| 3,715,027 | 2/1973 | Fujimoto | 198/806 |

*Primary Examiner*—Ronald E. Suter
*Attorney, Agent, or Firm*—Michael J. Striker

[57] ABSTRACT

A screen printing machine includes a pair of transversely spaced first rollers mounted for rotation about axes located in a common substantially horizontal plane, and a second roller which is mounted for rotation about a second axis substantially paralleling the first axes and being located in a higher second plane. An endless printing screen is placed about the rollers to be entrained by the same; in the space between the first rollers it defines a printing run. First adjusting arrangements are provided by means of which the second roller can be raised and lowered with reference to the first rollers, and second adjustments are provided by means of which the second roller can be displaced in its horizontal plane transversely of its axis of rotation.

17 Claims, 17 Drawing Figures

SCREEN PRINTING MACHINE WITH ADJUSTABLE END-MOUNTING UNITS

This is a continuation, of application Ser. No. 458,342, filed Apr. 5, 1974, now U.S. Pat. No. 3,995,552.

BACKGROUND OF THE INVENTION

The present invention relates generally to a screen printing machine, and more particularly to a screen printing machine having novel adjusting arrangements.

It is known to provide screen printing machines in which an endless printing screen travels about rollers, two of which have their axes of rotation located in a common horizontal plane so that the printing screen forms a printing run between these two rollers, that is a run in which printing takes place through the printing screen upon an underlying workpiece. This type of screen printing machine has certain disadvantages, including the most important one that if the workpiece becomes displaced transversely of the printing screen, that is axially of the rollers around which the printing screen is guided, there will no longer be any proper registry between the printing screen and the workpiece. Conversely, it is also known that quite frequently the printing screen itself will shift axially of the rollers with reference to the workpiece, leading to the same difficulties. In order to avoid this problem the two rollers between which the printing run is formed must be readjusted every time such a displacement of the printing screen and/or the workpiece occurs. This is particularly disadvantageous in the case of multi-pass printing, that is in case of multicolor printing or the like. Evidently, if one part of a pattern or the like has been printed onto a workpiece, and another part is to be overprinted, there must be precise registry between printing screen and workpiece because otherwise overlapping of the colors will occur, or other difficulties may arise from this lack of registry. The difficulty mentioned above arises from the fact that every time the rollers are readjusted, the printing screen itself, or at least that portion constituting the printing run, will shift with reference to the workpiece. Moreover, since the printing screen is located in the printing run directly on the workpiece, any shifting between printing screen and workpiece is disadvantageous, especially in the case of workpieces—such as rugs, carpets and the like—having a nap, because any relative displacement between printing screen and workpiece results in disturbing of the nap and thus in printing imperfections.

SUMMARY OF THE INVENTION

Accordingly, it is an object of the present invention to provide an improved screen printing machine which avoids these disadvantages of the prior art.

More particularly, it is an object of the invention to provide an improved screen printing machine in which it is possible to adjust the positioning of at least the printing run of the printing screen without requiring any adjustments of the rollers about which the printing screen is trained and between which it forms the printing run.

Another object of the invention is to provide such an improved screen printing machine wherein the aforementioned rollers will always be located in exact axial parallelism with one another, and will thus extend exactly normal to the direction of advancement of the workpiece, assuring that the printing run of the printing screen will contact the workpiece over the entire surface area of the printing run at uniform pressure.

Another object of the invention is to provide such an improved screen printing machine wherein it is assured that even under tension the aforementioned rollers will not change their relative position.

It is still another object of the invention to provide a screen printing machine which is capable—while avoiding the aforementioned disadvantages—of printing on relatively wide workpieces, so that according to the invention it is also important to prevent a flexing of the rollers and to prevent a loading of the rollers by the weight of the end-mounting units in which the rollers are journalled.

In keeping with the above objects, and with others which will become apparent hereafter, one feature of the invention resides in a screen printing machine, and more particularly in a combination in such a screen printing machine which includes a pair of transversely spaced first rollers mounted for rotation about first axes located in a common substantially horizontal plane, and a second roller which is mounted for rotation about a second axis which substantially parallels the first axes and is located in a higher second plane. An endless printing screen is placed about the rollers for entrainment by the same and defines in the space between the first rollers a printing run. First adjusting means is provided for raising and lowering the second roller with reference to the first rollers, and second adjustment means is provided for displacing the second roller in the second plane transversely of the second axis.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
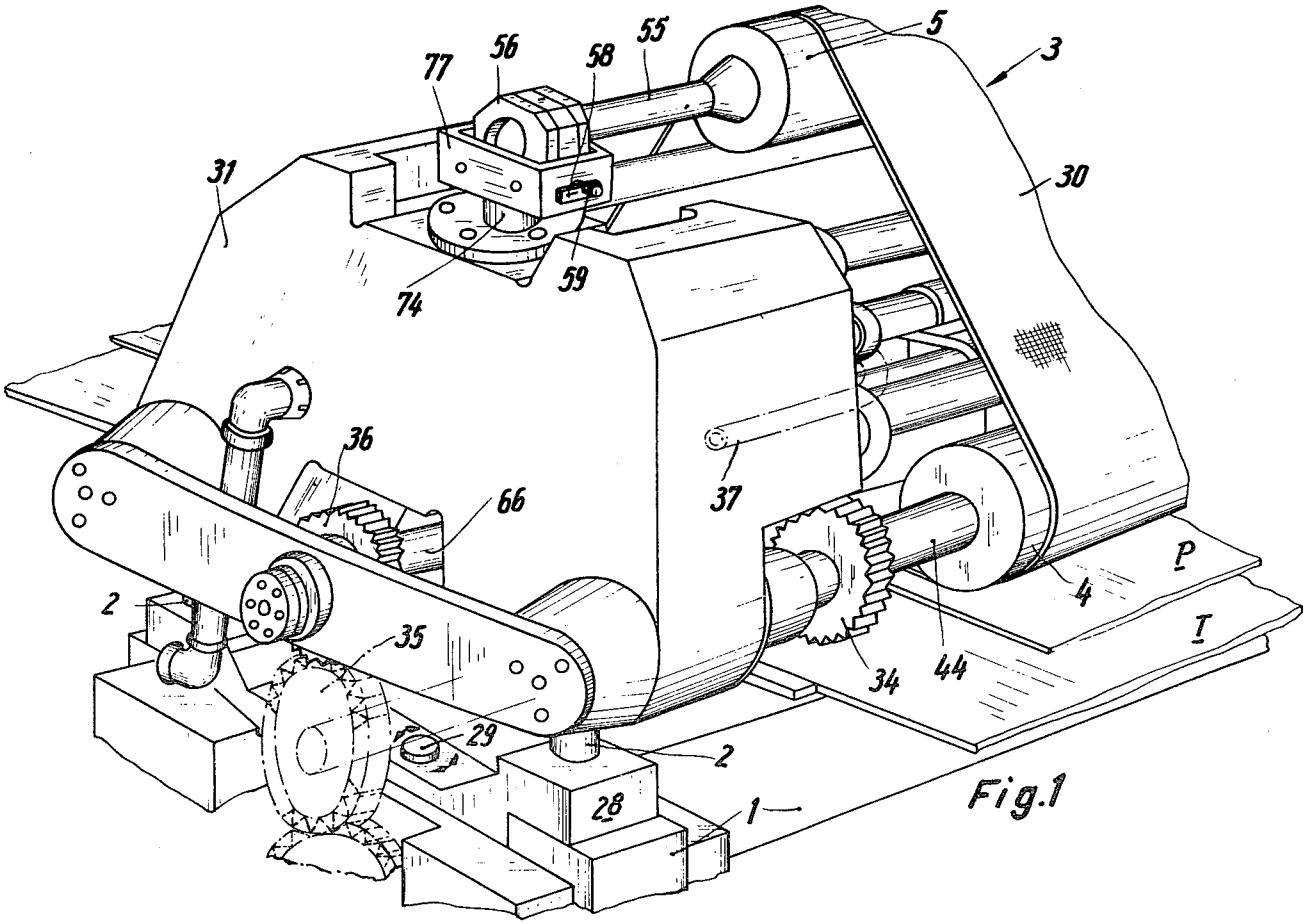
FIG. 1 is a fragmentary perspective view showing one end portion of a screen printing according to the present invention.

FIGS. 1–14 in the drawing show a single embodiment and should therefore be considered in conjunction with one another.

The illustrated screen printing machine has a frame or support 1 which can be of any desired construction. Mounted on the frame 1, as it will be called for the sake of convenience, is a printing unit 3 which is supported on four supports 2, 22. The supports 2 are located at one end of the printing unit 3, and the supports 22 which differ slightly from the supports 2 are located at the opposite end. These elements will be discussed in more detail later. It should be understood that the complete screen printing machine may be provided with more than one of the printing units 3, for instance if it is designed for multicolor printing in which case two or more of the units may be arranged one behind the other so that a workpiece would pass sequentially through them. The invention will, however, be described on hand of a single printing unit 3, since the details which will be given hereinafter will be applicable to all such printing units if more than one is provided.

The printing unit 3 has a pair of driven rollers 4 which rotate about parallel axes that are located in a common horizontal plane. A tensioning roller 5 is located upwardly spaced from the rollers 4, its axis of rotation being located in a higher second plane. An endless printing screen 30 is trained about the rollers 4, 4, 5 so that in vertical section it has a triangular configuration. The printing screen 30 can be of any known type, for instance a steel wire mesh which is advantageously galvanically nickel plated and in which each crossing point of intersecting wires is stabilized. Since the construction and preliminary treatment of such printing screens are both well known, and do not form a part of the invention, no further details are required herein.

Figure 2:
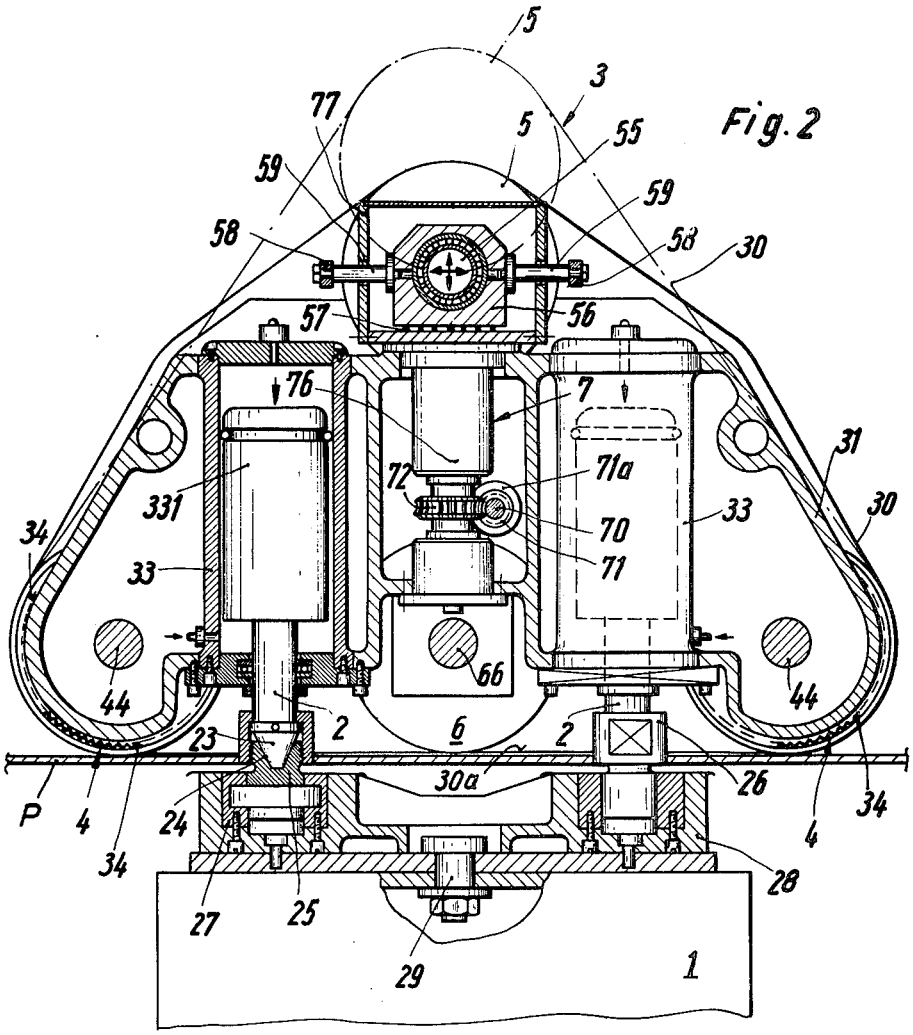
FIG. 2 is a fragmentary vertical section taken on line II—II (FIG. 1*a*)

FIG. 2 shows the printing screen 30 in full lines in a relaxed position in which it is not tensioned by the roller 5, and in chain lines in a tensioned (operating) position in which it is tensioned by the upward movement of the roller 5, as will be explained subsequently.

In the space between the rollers 4, each of which is mounted for rotation on a shaft 44 extending normal to the direction of travel of a workpiece in the working plane P (the travel is from left to right or from right to left in FIG. 2 and the shafts 44 extend normal to the plane of FIG. 2) the printing screen 30 forms a printing run 30*a*. It is here that printing ink is squeezed in conventional manner through the apertures of the printing screen 30 by a squeegee, for instance the illustrated squeegee roller 6 which rotates on a shaft 66 and rests lightly on the printing run 30*a*.

The roller 5 can be moved in vertical direction, that is it can be shifted between the full-line position in FIG. 2 and the chain-line position in the same Figure. As indicated earlier, this serves to tension or relax the printing screen 30. In addition, however, the roller 5 can be shifted in a horizontal plane that is it can be pivoted in a horizontal plane about one of its end portions, as will be explained later, and the purpose of this adjustment is so regulate the location of the printing screen 30 on the rollers 4, 4, 5 in the event the printing screen 30 has shifted axially of these rollers, without having to readjust the positions of the rollers 4, 4 themselves, as is necessary in the prior art.

Figure 1A:
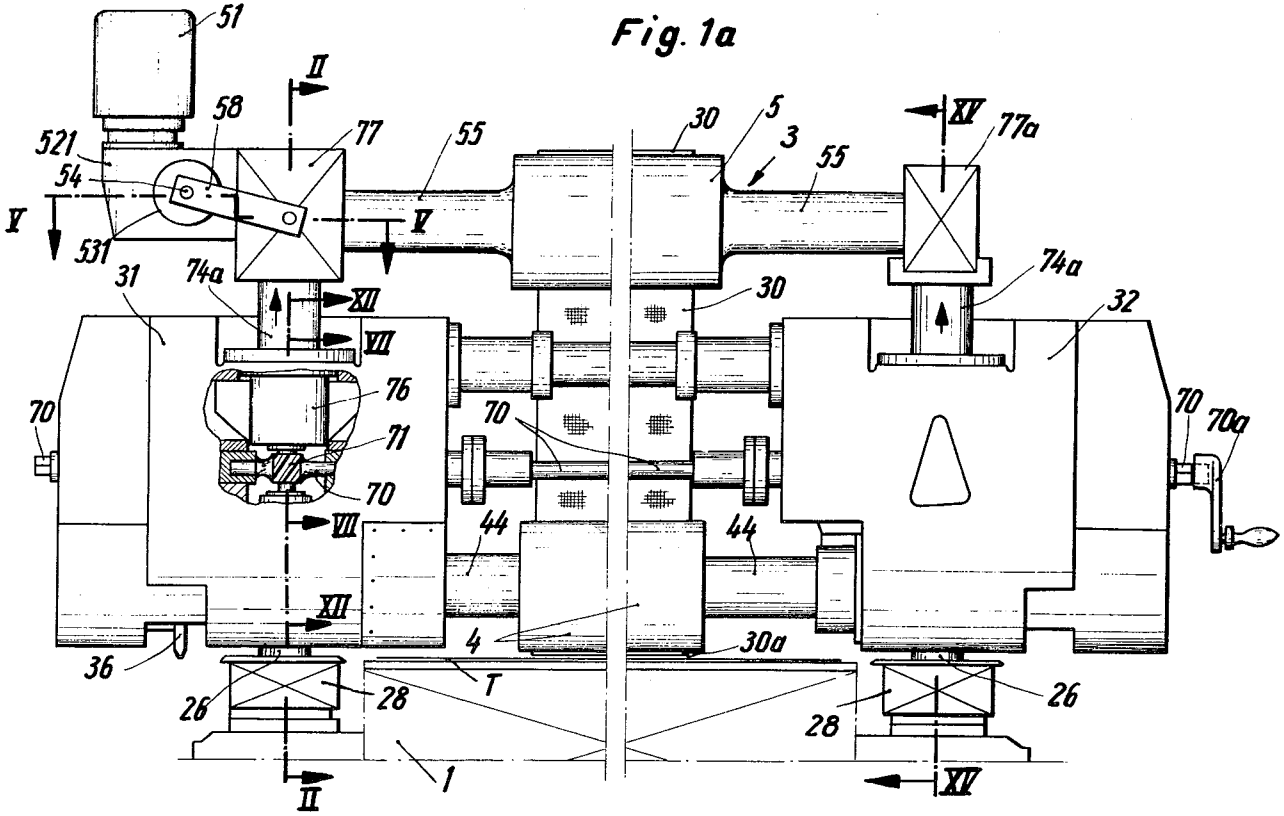
FIG. 1*a* is a diagrammatic side elevation of the screen printing machine.

The drawing shows in FIG. 1*a* that at the opposite axial ends of the printing unit 3 there are provided two end mounting units 31 and 32, respectively. Each of these units journals one end portion of the rollers 4, 4, 5. As the drawing also shows, for instance in FIG. 2 and in other Figures, each of the end mounting units 31 and 32 is provided with two vertically oriented lifting cylinders 33 which extend in axial parallelism with one another and which are fixedly connected with the units 31 and 32, respectively. Each of the cylinders 33 accommodates a piston 331 and into the interior of each cylinder 33, between the upper end of the latter and the upper end of the piston 331, a pressure fluid can be introduced as indicated by the arrow in the left-hand cylinder 33 in FIG. 2. No details of the connection required for this purpose have been shown, since this is evidently well within the skill of the art. It will also be appreciated that since the pistons 331 are supported in a manner still to be described on the frame 1, the admission of pressure fluid into the cylinders 33 will cause the latter to rise upwardly with respect to the pistons 331 and thus to lift the respective end-mounting unit 31 and 32 upwardly away from the working plane P. When this takes place, the position of the rollers 4, 4, 5 which exists at the time, remains unchanged. In other words, there will be no shifting or displacement of the rollers with reference to one another because the end-mounting units 31, 32 are raised. The same applies when these units are lowered upon termination of admission of pressure fluid. Since the shaft 66 of the squeegee roller 6 is also journalled in the end-mounting units 31, 32, the squeegee roller 6 also rises or descends with the end-mounting units 31, 32.

Figure 12:
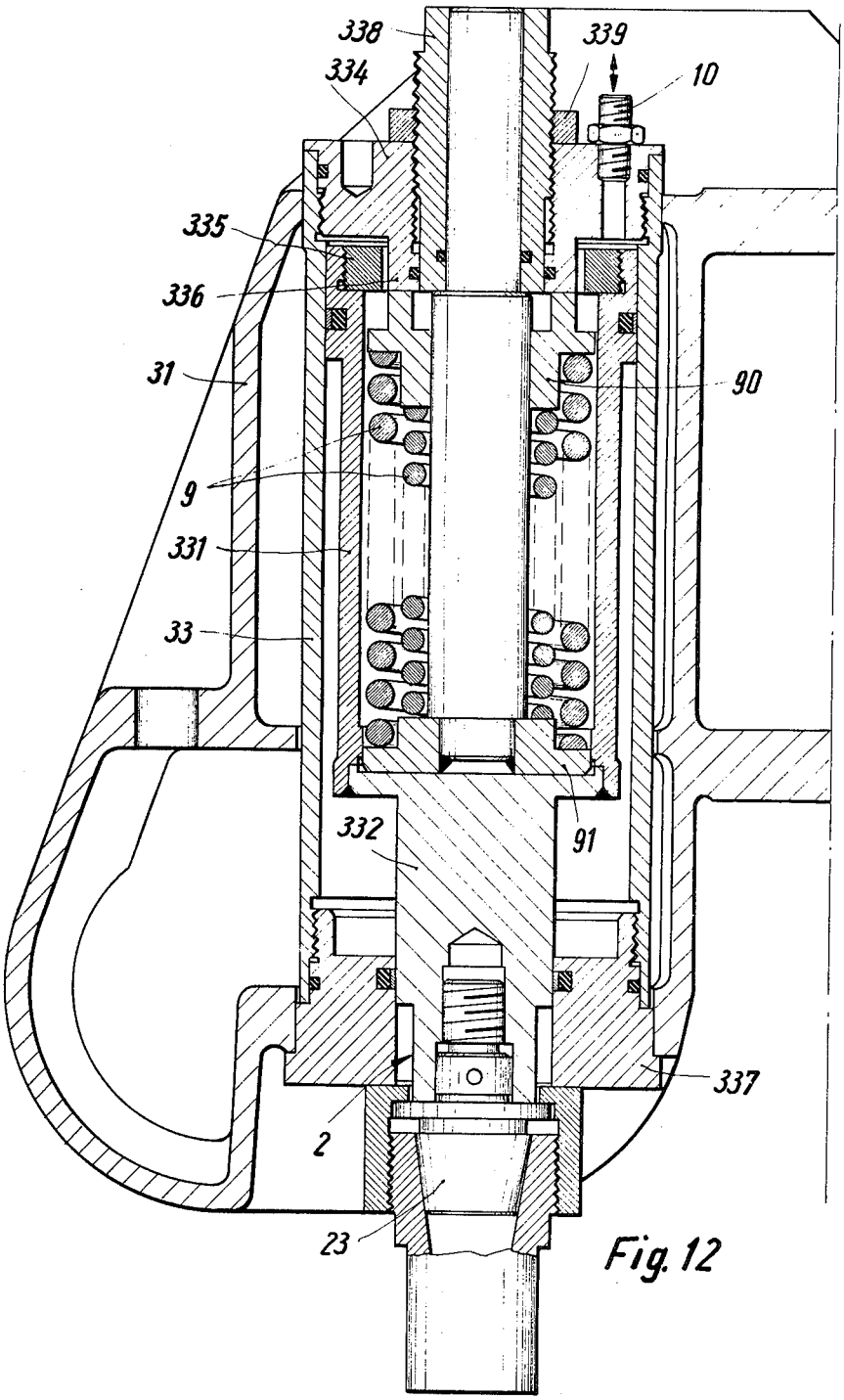
FIG. 12 is a vertical section taken on line XII—XII.
Figure 13:
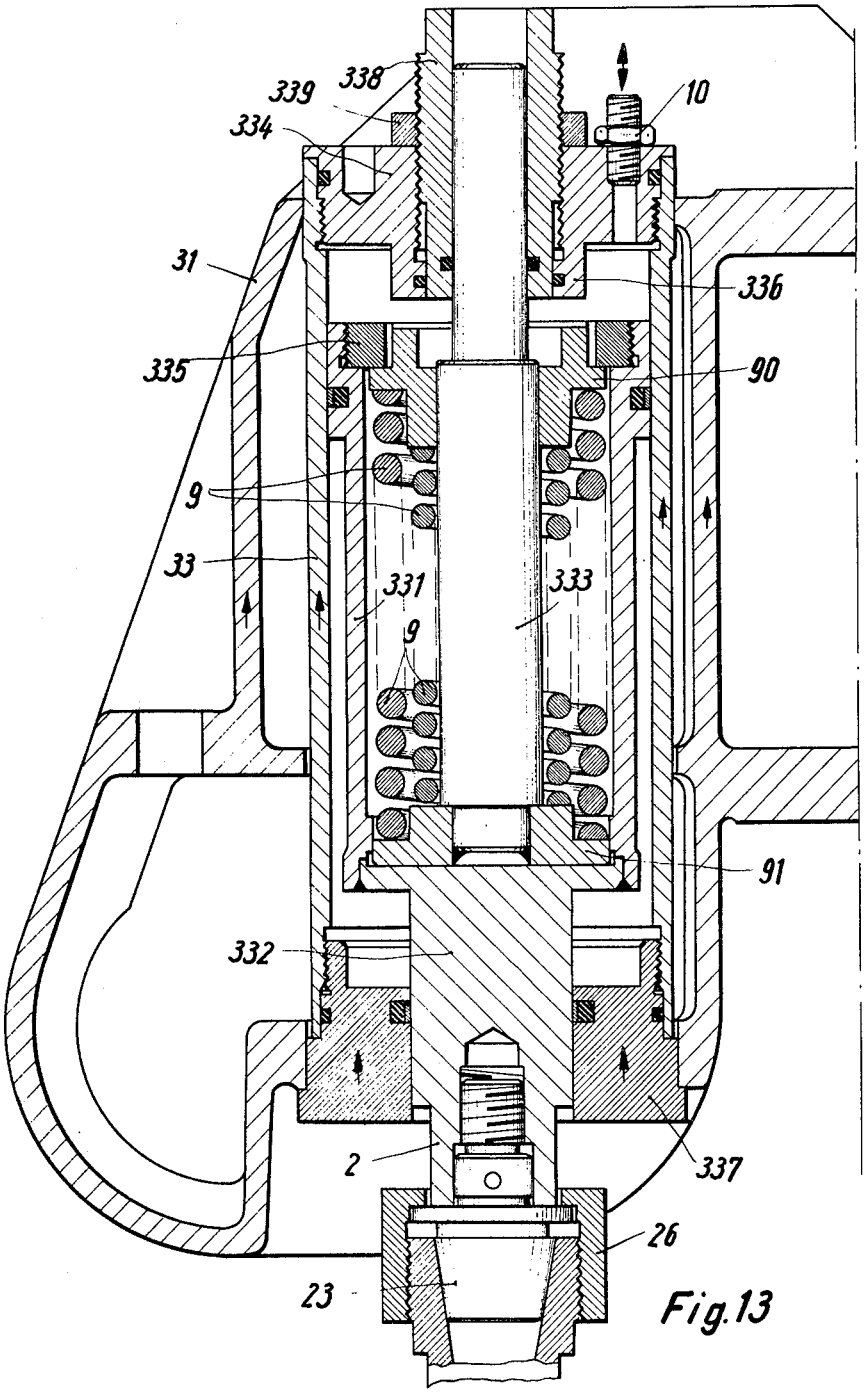
FIG. 13 is a view similar to FIG. 12, showing the same components as in FIG. 12 but in a different position.
Figure 14:
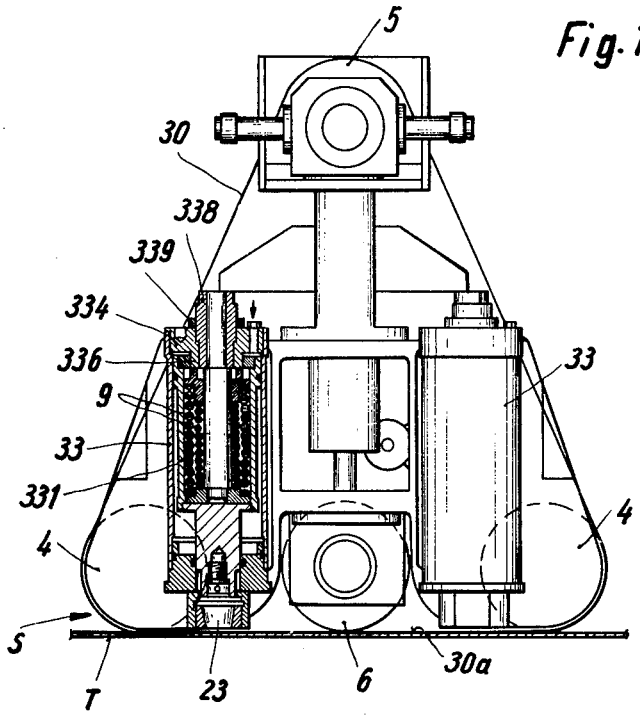
FIG. 14 is a diagrammatic partly sectioned end view of the novel screen printing machine.
Figure 15:
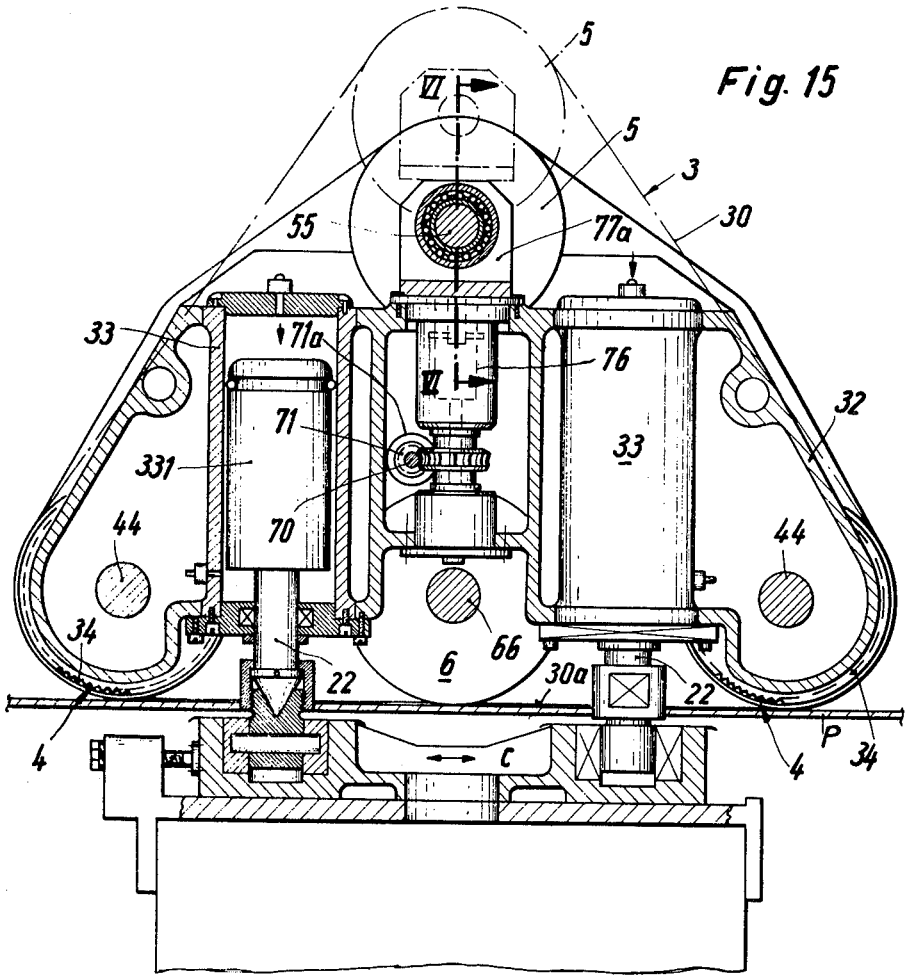
FIG. 15 is a fragmentary vertical section taken on line XV—XV.

The supports 2, 22 form part of the respective pistons 331, and thus the end-mounting units 31, 32 and the various associated rollers and squeegee will rest on these supports when the end-mounting units are raised. Details of the construction of the supports 2 and their associated cylinders 33 are shown in FIGS. 12–14 and will be subsequently described. The pistons 331 in this embodiment are constructed as hollow pistons and provided with biasing springs which serve to relieve the weight of the end-mounting units 31, 32 as will also be described later.

Figure 7:
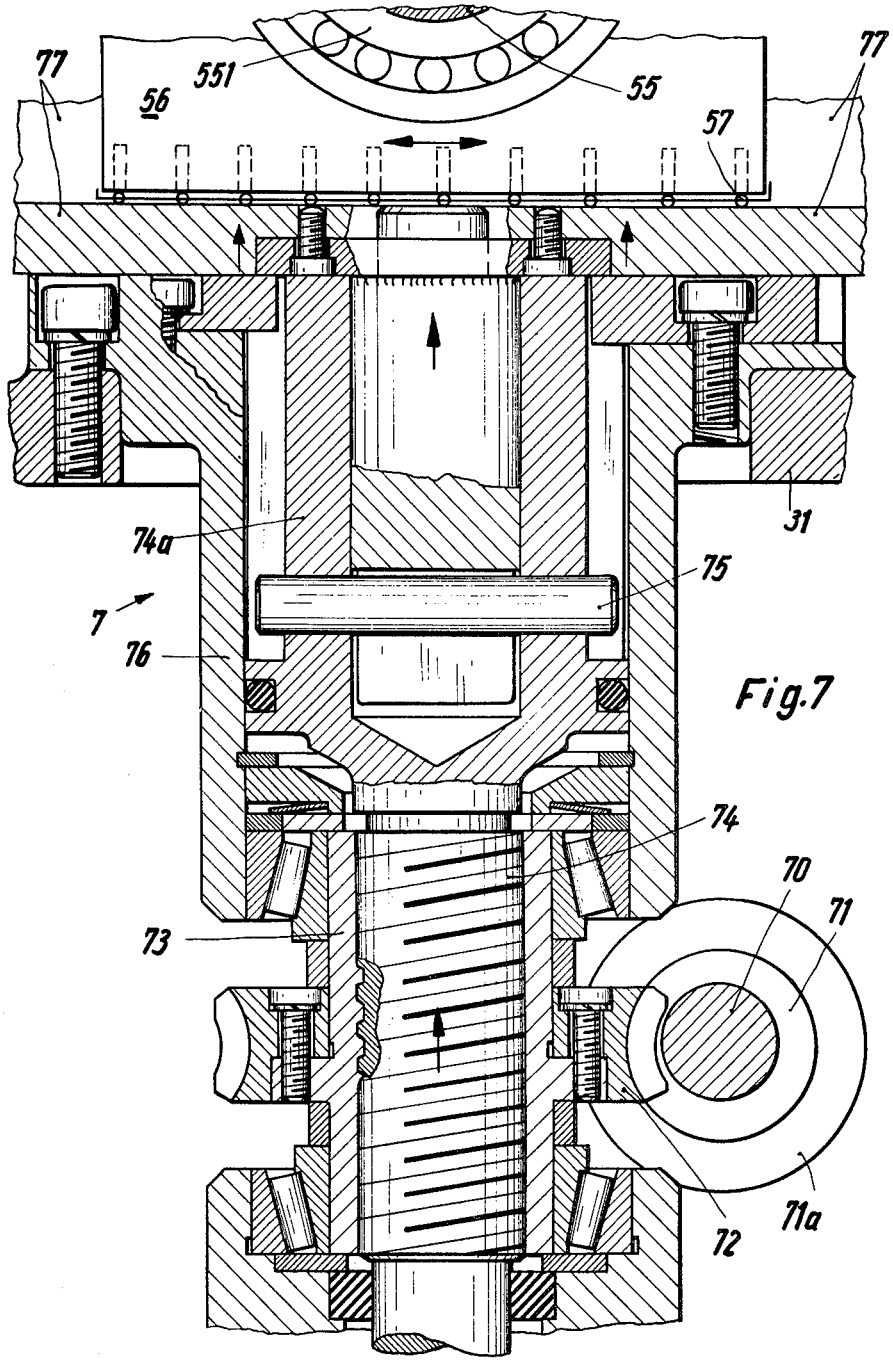
FIG. 7 is a fragmentary vertical section taken on line VII—VII (FIG. 1*a*)
Figure 8:
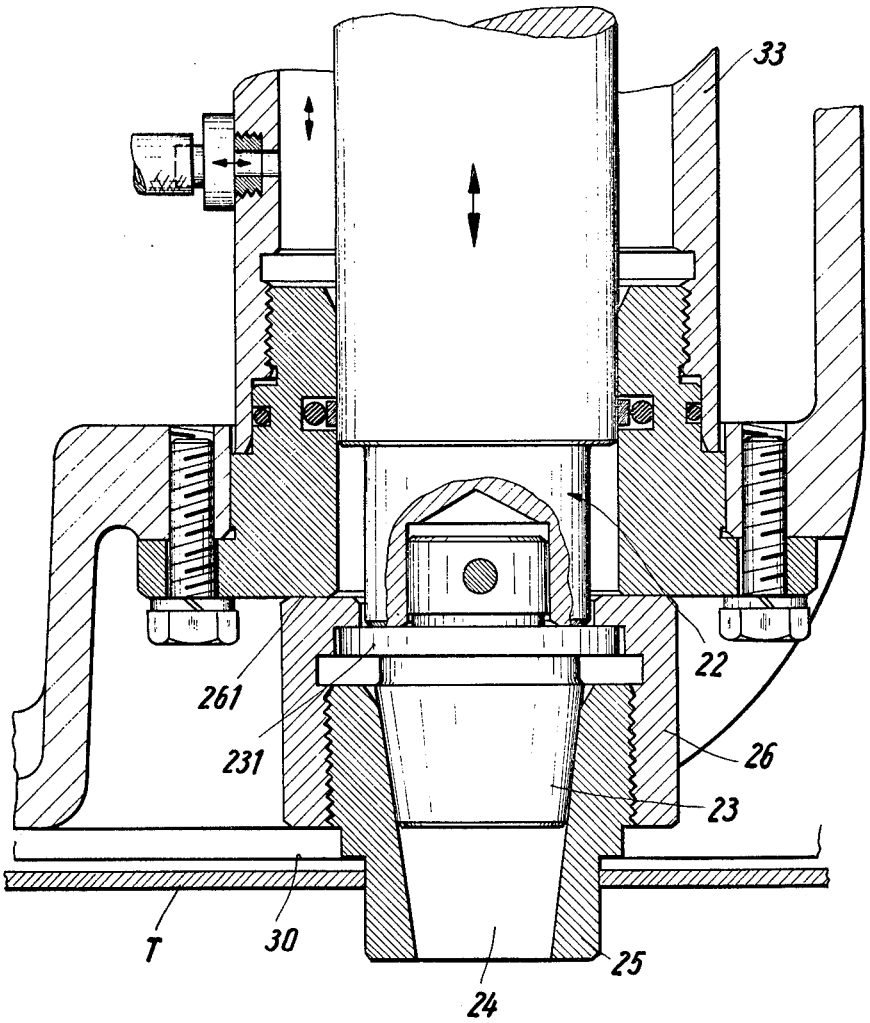
FIG. 8 is a fragmentary enlarged view, in section, showing a detail of FIG. 2.

It will now firstly be described how the roller 5 can be raised and lowered, an operation which should be carried out uniformly at both opposite ends of the roller 5. For this purpose a lifting mechanism 7 is provided which in the illustrated embodiments uses a driven shaft 70 which extends longitudinally of the roller 5 and is formed in the region of each of the end-mounting units 31, 32 with a worm 71 as shown in FIG. 7. The shaft 70 can be rotated in suitable manner, for instance by a motor 71*a* and is journalled in the end-mounting units 31, 32 as are the rollers 4, 4, 5, or, manually, at both ends of the shaft, by a crank-handle 70*a*. Also located at each of the end mounting units is a vertical sleeve 73 which can rotate about a vertical axis but is fixed against vertical displacement. Mounted on the exterior of each sleeve for rotation with the same is a worm wheel 72 which meshes with the respectively associated worm 71. Each sleeve 73 is interiorily tapped and accommodates a spindle 74 the threads of which mesh with the interior threads of the sleeve 73; the threads of the spindle 74 are preferably of trapezoidal configuration. Each spindle 74 has a head 74*a*, which is guided by means of a vertical guide 75 in a housing 76 or 76*a* and which engages with its upper end the underside of a bearing box 77 or 77*a* in which the bearings for the shaft 55 of the roller 5 are located. This will be described subsequently. It will be appreciated that when the shaft 70 rotates and thus turns via the worms 71 the worm wheels 72, these in turn cause a respectively associated sleeve 73 to turn about the upright axis of the latter, causing (depending upon direction of rotation of the shaft 70) the spindle 74 to move upwardly or downwardly in the associated sleeve 73. This results either in lifting or lowering of the respective bearing box 77 or 77*a*. Thus, when it is desired to move the printing screen 30 to operative position, that is to ready it for printing, the roller 5 is raised in this manner, thereby tensioning the printing screen 30 which is entrained by friction by the rollers 4, 4. Conversely, when the printing screen 30 is to be removed from the machine, or when preparations are made to install a new printing screen in the machine, the roller 5 is lowered to the full-line position in FIG. 2.

Figures 2A, 3:
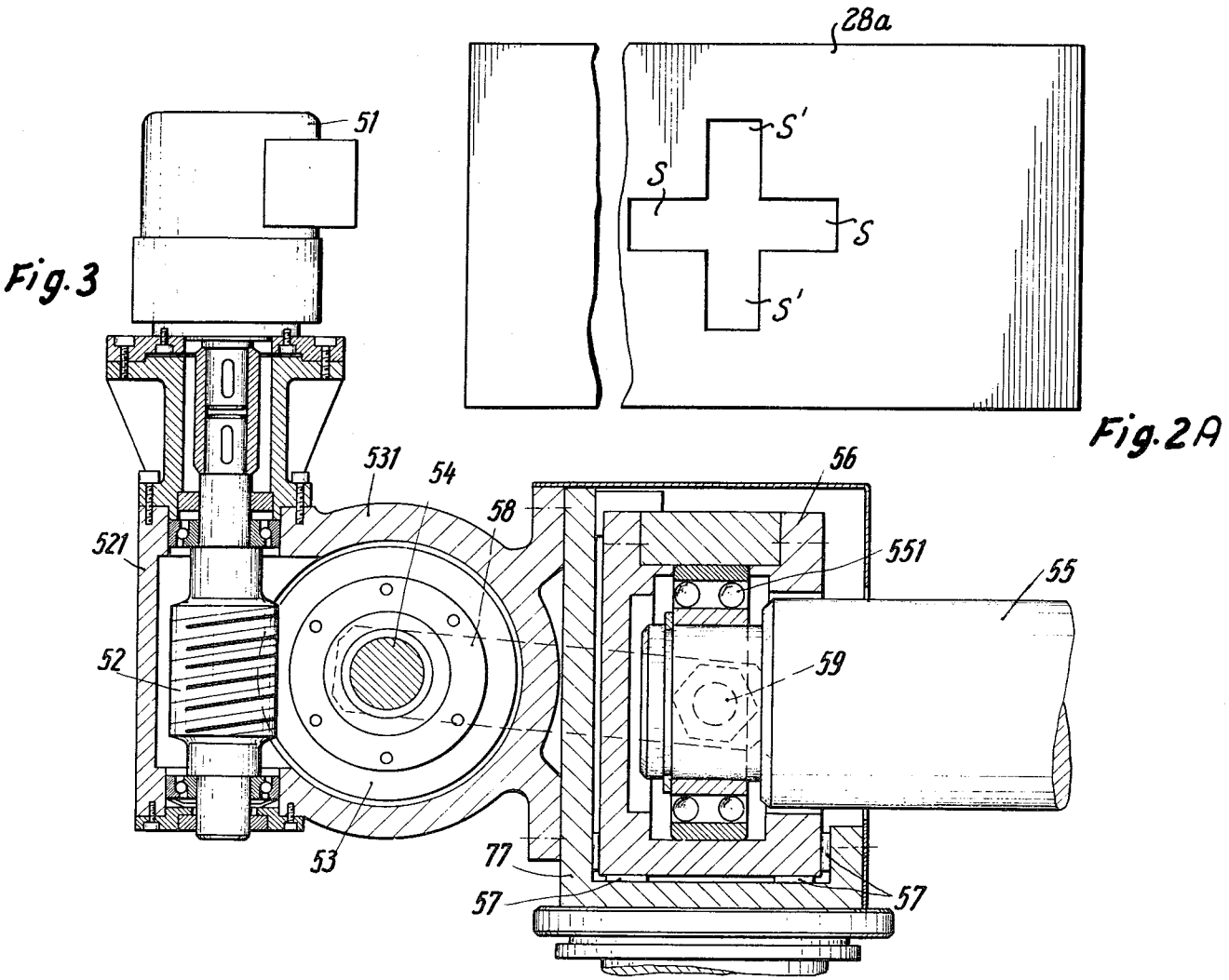
FIG. 2A is a diagrammatic top-plan view of a modification.
FIG. 3 is a fragmentary section taken on line III—III (FIG. 5)
Figure 4:
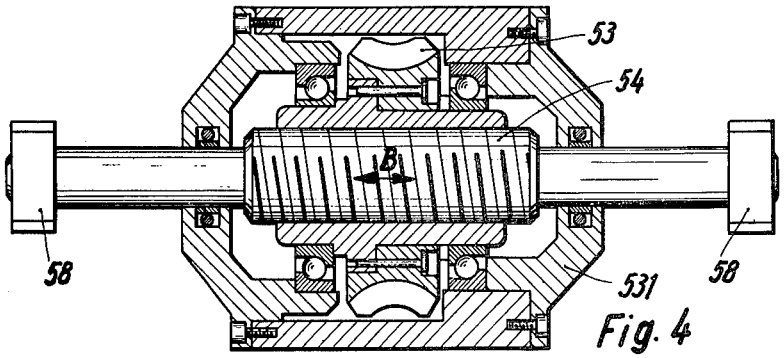
FIG. 4 is a fragmentary vertical section taken on line IV—IV (FIG. 5)
Figure 5:
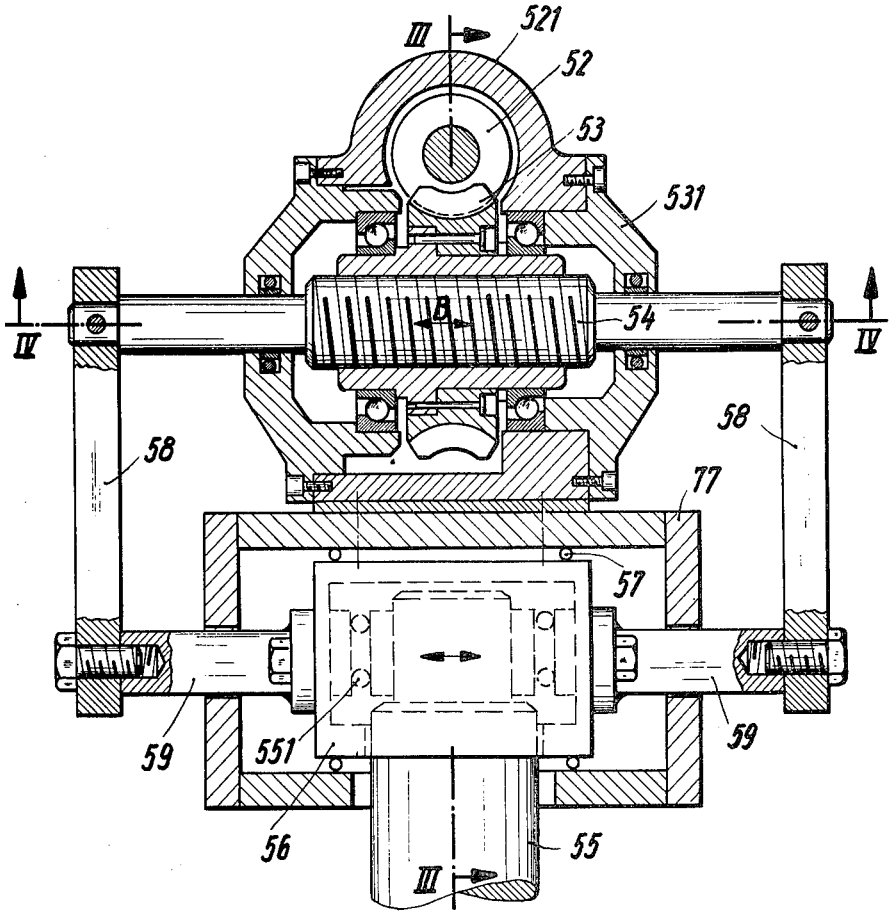
FIG. 5 is a fragmentary horizontal section taken on line V—V (FIG. 1*a*)

When adjustments are to be made in the travel of the printing screen 30, for instance because the printing screen has shifted axially on the rollers 4, 4, 5 and is to be returned to its predetermined position relative to these rollers, the roller 5 with its shaft 55 is horizontally displaced, that is it is pivoted about one end portion in a horizontal plane. For this purpose each of the end-mounting units 31 and 32 is provided with appropriate arrangements in the respective bearing boxes 77. FIG. 3 shows that the bearing box at one end of the roller 5 is provided with a movable bearing 56 which is mounted on antifriction bearings (roller bearings or ball bearings) 57 and can be displaced in a horizontal plane at a right angle to the axis of rotation of the shaft 55. This displacement is effected in the illustrated embodiment by means of an arrangement using a motor 51, preferably a reversible electromotor, which drives a worm 52. The latter in turn meshes with a worm wheel 53 mounted on and turnable with an internally tapped sleeve in which a threaded spindle 54 is accommodated. The worm 52 is mounted in a housing 521 and the worm wheel 53 in a housing 531. At the opposite axial ends of the spindle 54 there are mounted arms 58 the free end portions of which are in turn secured to support members 59 which are connected with the shiftable bearing 56, as most clearly shown in FIG. 5. When the worm wheel 53 is turned in one or the other direction, the spindle 54 shifts axially in the direction of the double-headed arrow B, the direction of shifting depending upon the direction in which worm wheel 53 is rotated. Thus, one or the other of the arms 58 will push the bearing 56 in a direction transversely of the longitudinal axis of rotation of the shaft 55, the bearing 56 moving on the antifriction bearings 57. In its interior, the bearing 56 accommodates an antifriction bearing 551 in which the shaft 55 is journalled for rotation and which, of course, moves with the bearing 56.

Figure 6:
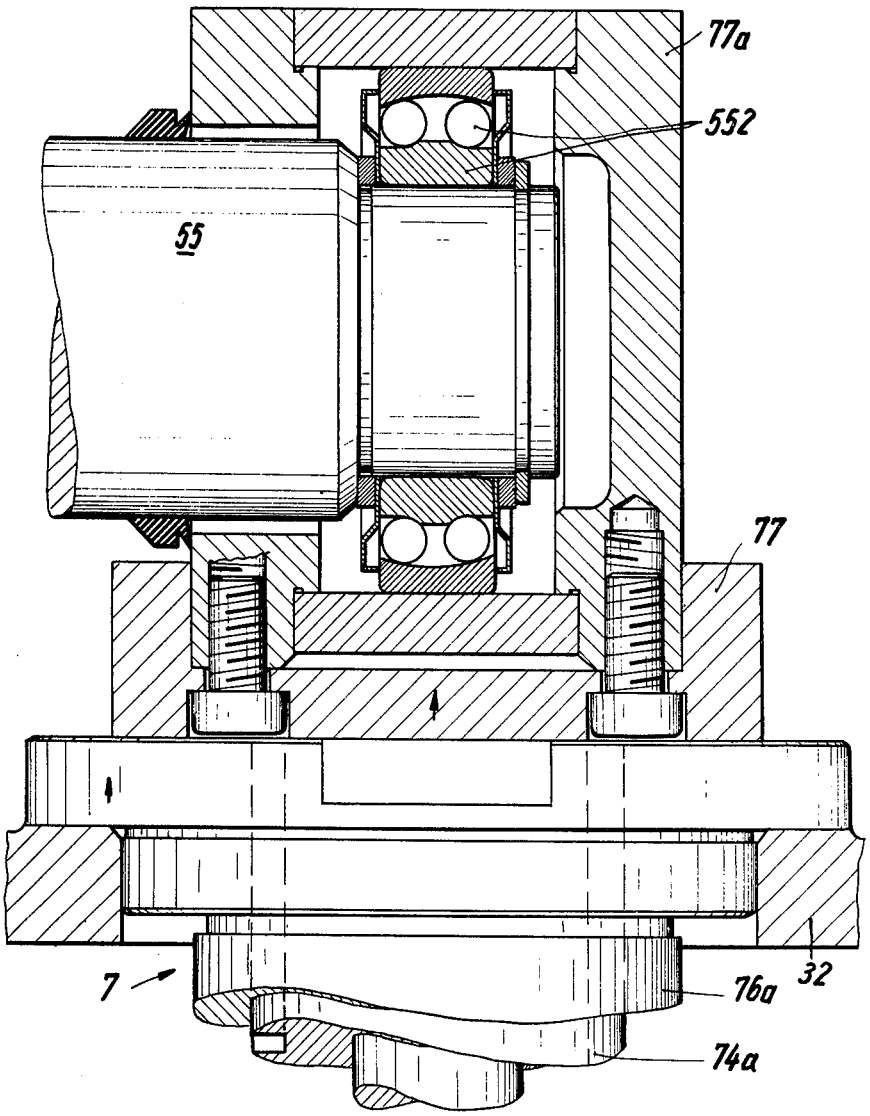
FIG. 6 is a fragmentary vertical section showing the journalling of one end portion of one of the rollers taken on line VI—VI (FIG. 1*a*)

It is possible to provide the arrangement just described at both axial ends of the shaft 55. However, for reasons of economy, it is advantageous to provide it at only one axial end, since at the other axial end a pivotable bearing 552 can be provided, which is a bearing of a type known per se and is accommodated in the associated bearing box 77*a*, as shown in FIG. 6. Since the pivotable bearing 552 can pivot about a vertical axis, any transverse displacement of the shaft 55 at the opposite end thereof will cause the bearing 552 to pivot about the vertical axis, permitting the desired lateral displacement of the roller 5. It will be appreciated that there must be some play in the journalling of the shaft 55 in the bearing 551.

By resorting to the arrangement described above, the roller 5 can be pivoted in a horizontal direction whereby a control of the axial running-out of the printing screen 30 is possible without having to carry out any adjustments in the positioning of the rollers 4, 4. Lateral sensors can be provided, if desired, to electrically or electronically control the energizing and direction reversing of the motor 51, thereby providing for an automatic control which compensates for any undesired displacements of the printing screen 30.

Figure 9:
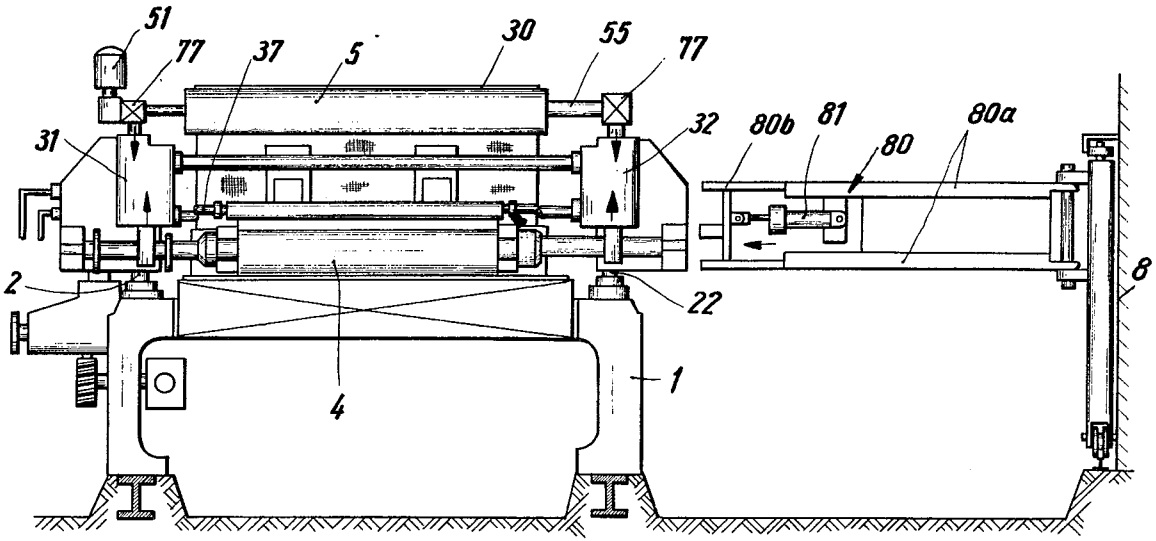
FIG. 9 is a diagrammatic side elevation of the machine showing one stage of a printing screen removal operation.
Figure 10:
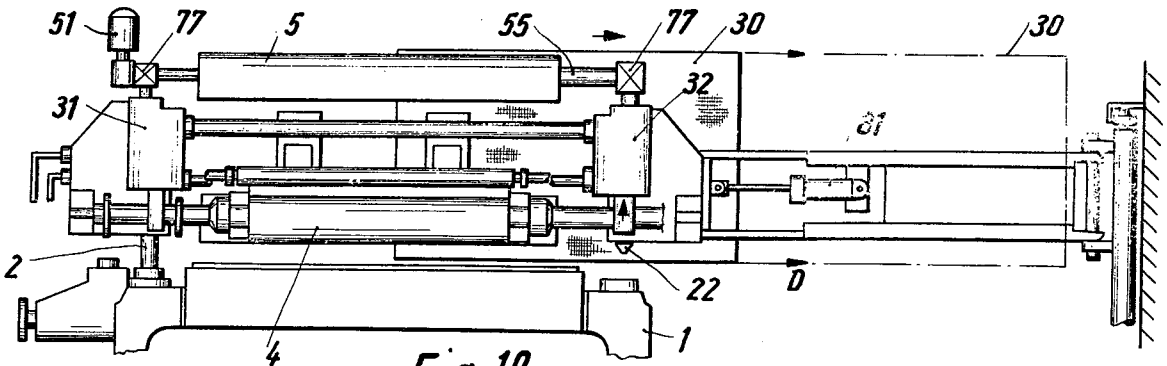
FIG. 10 is a view similar to FIG. 9, showing a further stage beyond the one shown in FIG. 9.
Figure 11:
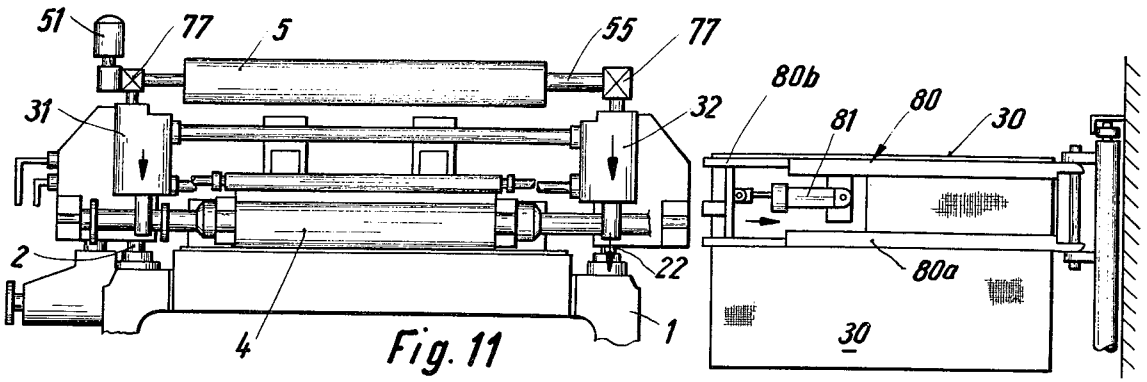
FIG. 11 is a view similar to FIG. 10, showing an additional stage beyond the stage shown in FIG. 10.

In order to be able to remove the printing screen 30 from the apparatus, or to install a new one, it is necessary that the supports at one end of the printing unit 3 be of the type that can be retracted after it has been used to raise the associated end-mounting unit 31 or 32, in order to provide a gap in which the printing screen 30 can be slipped, as shown in FIGS. 9–11. In the illustrated embodiment it is the supports 22 which have been so constructed and which have been shown associated with the end-mounting unit 32, but could be provided on the end-mounting unit 31 if desired. These supports 32 are provided with conical centering members 23 which engage a concial recess 24 provided in support members 25. The latter are provided above the working table T with external threads, so that a respective cap nut 26 can be threaded onto to them. The cap nut engages the respective centering member 23 via an annular flange 231. By appropriate turning of the respective cap nut 26, the support plane 261 for the end-mounting unit can be adjusted, that is can be raised or lowered. It is important that a fixed connection be provided between the centering member 23 and the associated support member 25 which in turn is supported by support 27 provided on an adjustable plate 28. The plate 28 can be adjusted in a horizontal plane, for instance by means of preferably eccentric bolt 29. The bolt can have a cylindrical portion which may be mounted in the frame 1 for rotation and an eccentric portion which engages an opening in the plate 28, or vice versa. As shown in FIG. 2A, it is also possible to provide a plate 28*a* corresponding to the plate 28 with two slots S and S′ which intersect one another, the bolt can then extend into these slots so that the plate has freedom of movement in a horizontal plane in two mutually inclined directions.

The necessity for this particular construction of the supports 22 will become clearer from a consideration of FIGS. 9–11 which show three successive stages in the removal of a printing screen 30 from the machine. In the first stage, as shown in FIG. 9, the roller 5 is lowered to the full-line position of FIG. 2. Subsequently, the cylinders 33 receive pressure fluid to thereby raise the end-mounting units 31 and 32 to an upper position. At this time, the supports 2 and 22 are also extended in vertical direction. In this position, a holding unit which is shown in FIG. 9 to be mounted on a fixed wall 8, preferably for pivotal movement about an upright pivot axis, as shown, is utilized to hold the respectively adjacent end-mounting unit, here the end-mounting unit 32. The holding unit is identified in toto with reference numeral 80 and in the illustrated embodiment has arms 80*a* and additional arms 80*b* which are telescopable into and out of the arms 80*a* by means of a suitable device and is indicated by the arrow C, for instance by means of a fluid-operated cylinder and piston unit 81. When the arms 80*b* are extended towards the left in FIG. 9, they engage the end-mounting unit 32 to which they can be connected in any desirable manner, which does not form a part of the invention. Once they are so connected with the end-mounting unit 32, they support the latter and make it possible for the supports 22 to be upwardly retracted to the position shown in FIG. 10. This leaves the illustrated gap. Of course, the respective cap nut 26 must be disengaged from the centering members 23 before such upright retraction can take place. After the non-illustrated supply connection for the supply of ink into the interior of the printing screen 30 has been disconnected, the printing screen 30 can now be moved in the direction of the arrows D to the position shown in FIG. 1 and thereupon it can be rested upon the arms 80*a*, 80*b* of the holding unit 80, in the position shown in FIG. 11. During this time, the arms 80*a*, 80*b* hold the end-mounting unit 32 which is not supported by the units 22. After the printing screen 30 has been removed, the supports 22 can again be downwardly extended to support the end-mounting unit 32, and the arms 80*b* can be disconnected from the unit 32. The unit 80 can now be shifted along the wall 8 or pivoted with reference to it, to such a position that the printing screen 30 can be withdrawn from it. If necessary or desired, the entire printing unit 3 can now be replaced, or any inspection or repair on its various components can be carried out, unhindered by the presence of the printing screen 30. Subsequently, a new printing screen 30 can be installed by reversing the operations shown in FIGS. 9–11.

It is important that the weight of the printing unit 3, inluding the end-mounting units 31, 32 thereof, not be supported fully by the workpiece being printed, for the reasons which have been outlined earlier. To avoid this, the construction shown in FIGS. 12–14 is utilized, according to which the pistons 331 in the cylinders 33 are constructed as hollow pistons. The piston rod 332 in effect constitutes the respective support 2 or 22, carrying at its lower end the centering member 23 which has been previously described. If the printing unit 3 is complete to be taken off, all four cup nuts 26, pressing the centering members 23 in the conicial recess 24, must be screwed off, before the upwards directed movement may be done. For this movement of the printing unit a crane is needed.

The interior of each of the hollow pistons 331, of which only one is shown by way of example in FIGS. 12–14, accommodates two or more helical expansion springs 9 which bear at their opposite ends against annular members 90 and 91, respectively. The annular member 91 is located in the region of the bottom wall of the hollow piston 331, engaging the piston rod 332 under the force of the springs 9. It surrounds a portion of an inner extension of the piston rod 332, which extension passes through the interior of the hollow piston 331, as shown, and is surrounded at its free upper end by the annular member 90. In the region where the portion of piston rod 332 that extends through the piston 331 is adjacent the cover 334 that closes the upper open end of the cylinder 33, this portion 333 is provided with a shoulder. The portion 333 is axially shiftably guided in the cover 334. The ring 90 engages an abutment ring 335 which surrounds the piston 331 at the upper end thereof but does not seal it. This means that the ring 90 is floatingly mounted and can shift axially toward and away from the ring 91 against the biasing force of the springs 9. The cover 334 is formed with a tubular extension 336. The outer diameter is so selected that it can be readily inserted into the ring 335. FIG. 12 shows that the tubular extension 336 engages the ring 90 and presses it inwardly of the hollow piston against the urging of the springs 9. Thus, the ring 90 is out of engagement with the abutment ring 335. It will be appreciated that if compressed air or other fluid is introduced through a nipple 90 provided on the cover 334, and connected in non-illustrated and well known manner with a source of such compressed fluid, the entire arrangement will assume the position shown in FIG. 13 in which the ring 90 can move into abutment with the ring 335 under the effect of the springs 9. The springs 9 can have different spring characteristics and one can be located inside the other, as shown. However, only a single strong spring could be utilized if desired. Considering the weights involved, it is preferable to use two of these springs. With such a construction, there will be four springs associated with each of the end-mounting units 31, 32.

When the end-mounting unit is in a position in which the arrangement assumes the operating mode shown in FIG. 12, then the two springs 9 in each of the cylinders 33 serve to counteract the weight of the respective end-mounting unit 31, 32, in such a manner that only a residual weight remains which properly holds the end-mounting unit 31, 32 in the working plane P. This residual weight can be adjusted, as can be the extent of displacement of the piston 331, by threading the cover 334 into the associated cylinder 33 to a greater or lesser degree. When the printing screen 30 travels in its working run 30*a* over a seam in the workpiece, or some other projecting part, such as a thicker part in the workpiece, then the entire end-mounting unit can yield in upward direction due to the construction in FIGS. 12 and 13. If the arrangement is to be returned from the operating position to the position shown in FIG. 2, then compressed air is admitted into the interior of the pistons 331, and this causes displacement to the position shown in FIG. 2, in which the respective end-mounting unit 31 or 32 raises off its seat on the respective cap nuts 26, the supports 2 with the piston rods 332 and the portion 333 stay in position, whereas the end-mounting units 31, 32 with the cylinders 33, the lower cover 337 for the cylinders 33, and the upper cover 334 as well as the guide sleeves 338 for the piston rod portions 333 rise upwardly to the position shown in FIG. 13.

The end-mounting unit 32 is retained in these upper positions when the printing screen 30 is to be removed or replaced in accordance with the illustrations in FIGS. 9–11, the holding being effected by the unit 80. In order to retract the supports 22 upwardly, as described earlier, the pistons 331 are shifted upwardly after previously releasing the cap nuts 36 until they reach the position shown in FIG. 12. It is clear that the supports 2 could be replaced with supports 22, so that both of the end-mounting units would be provided with such supports, but this will ordinarily not be necessary. It is evidently also possible to make various other modifications in the supports 2 and 22.

When the end-mounting units 31 and 32 are to be lowered again, advantageously simultaneously and uniformly in order to prevent bending or flexing of the rollers 4, 5, then the cap nuts 26 can be adjusted beforehand to regulate the level at which the units 31, 32 will be supported, since these units will rest on the cap nuts 26. However, the actual height adjustment takes place via the sleeves 338 which cooperate with the illustrated shoulders on the piston rod portions 333. When the respective end-mounting unit is lowered, it will raise when the sleeves 333 are threaded into the covers 334 to a greater or lesser degree. This causes pressure upon the piston rod portion 333, and thus raises the associated end-mounting unit 31, 32. If desired, the sleeves 338 can be used to provide a gap indicated by the arrow S in FIG. 14, which can be adjusted by turning the sleeves 338 in requisite sense, to accommodate it to different materials. For instance, in the case of thin carpets to be printed, a different distance of the working run 30*a* is required from the carpet or workpiece than in the case of high-napped carpets. In case of thin carpets, a gap of, for instance, 2 mm. may be required and in case of high-napped carpets the gap may have to be 5 mm. wide during the printing. If high-napped carpets are to be printed, they must, for instance, not be compressed to more than approximately 5 mm., which is very important in order to obtain a proper printing. In addition, the manufacturing tolerances are normally not very precise, so that adjustments in this gap are necessary from side-to-side and end-to-end of the machine, and these adjustments can be carried out in the manner just described. Once a respective sleeve 338 has been turned to the required position, it is fixed in this position by a counter nut 339 which arrests it. Readjustments of the sleeves 338 are not necessary until a workpiece of a different thickness must be printed. Evidently, the adjustments outlined herein affect not only the rollers 4, but at the same time also the squeegee 6 which is journalled in the end-mounting units 31, 32. The more deeply the sleeves 338 are threaded into the covers 334, the greater will be gap S, and the less will be the pressure with which the workpiece will be engaged. Such precision of adjustment, particularly over very wide workpieces of, for instance, several meters width, is not possible with any of the prior-art arrangements.

The drive of the rollers 4 which entrain the printing screen 30 can be carried out by mounting gears 34 on their shafts 44, and by having the gears 34 of one or both of the shafts mesh with a driven input gear 35. However, as shown in FIG. 1, it is also possible to have the input gear 35 mesh with a gear 36 that is mounted on the shaft 66 of the squeegee 6, and to provide a (non-illustrated) gear on the shaft 66 by means of which motion is transmitted to the gears 34 on the shafts 44. The ink supply conduit 37 is diagrammatically shown in FIG. 1, and supplies ink to the interior of the printing screen in a manner which is well known in the art and requires no detailed discussion.

Variations in the illustrated embodiment will offer themselves to those skilled in the art and intended to be included within the scope of the present invention. The springs 9 could act directly upon the tubular projection 336, and the members 90 and 335 could then be omitted. However, the illustrated embodiment is preferred because it is more advantageous. It will also be possible to use a different squeegee arrangement than the one that is illustrated, and the manner in which the various rollers are driven could be varied. The ink conduit 37 must, of course, be able to participate in the up and down movements of the end-mounting units 31, 32. It is also possible to provide more than two of the rollers 4, and it is conceivably possible to provide more than one of the rollers 5, although the illustrated embodiment is particularly advantageous. Guide rollers could be provided in addition to the rollers 4, 4, 5 to guide the printing screen 30 intermediate these rollers.

The present invention achieves the particularly important advantage that the printing run 30*a* of the printing screen 30 intermediate the rollers 4, 4 will contact the workpiece without any displacement relative to the same except in the direction of travel. This assures that there will be absolutely no smearing or otherwise disadvantageous influence upon the print. Regulation of the position of the printing screen 30 via the roller 5 can be carried out at any time, even during the operation to accommodate it to existing or changing conditions. All of this is facilitated by in effect floating the end-mounting units 31 and 32 in the manner described hereinbefore. The extent to which the end-mounting units 31, 32 can shift upwardly is the printing screen moves over a seam or other projection of the workpiece, should ordinarily not exceed approximately 12 mm., but exceptions are conceivable.

It will be understood that each of the elements described above, or two or more together, may also find a useful application in other types of constructions differing from the type described above.

While the invention has been illustrated and described as embodied in a screen printing machine having adjustable end-mounting units, it is not intended to be limited to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a screen printing machine, in combination, roller means comprising at least a pair of transversely spaced first guide rollers; means comprising a support and a pair of end mounting units thereon and mounting said first guide rollers for rotation about fixed first axes which are located in a common first plane; a second roller mounted for rotation about a second axis which is normally in a first position wherein it parallels said first axes and which is located in a second plane parallel to said first plane; an endless travelling printing screen band trained about said rollers for entrainment thereby and defining in the space between said first rollers a planar printing run parallel to said planes and having an operating position in which it is juxtaposed with a web to be printed, said band tending at least at times to shift axially of said rollers during entrainment by the same so that said printing run moves out of its operating position; restoring means for moving said band during the travel thereof axially of said rollers in direction counter to the axial shift for restoring said printing run to said operating position thereof, said restoring means comprising a pair of shaft bearings each journalling one end of said second roller for rotation, pivot means mounting one of said shaft bearings for pivotal movement about an upright axis, and first adjusting means mounting the other of said shaft bearings for displacement in a path parallel to said planes and transverse to said first axes, for pivoting said second roller and said second axis thereof in said second plane about said upright axis from said first position to a plurality of second positions in each of which said second roller extends skew to said first axes; and means for shifting at least one of said mounting units parallel to said planes with reference to said support, including a plate on said support and carrying lifting means for lifting said units, and bolt means connecting said plate with said support and being operative for displacing said plate with reference to said support.

2. A combination as defined in claim 1; and squeegee means comprising a squeegee engaging an upwardly directed side of said printing screen intermediate said first rollers in said printing run of said printing screen.

3. A combination as defined in claim 1, wherein said lifting means comprises upright cylinder and piston units each having one component fixed with one of said mounting units, and another component displaceable in upright direction relative to said one component and having a lower end portion which is supported by said support.

4. A combination as defined in claim 3, wherein each of said mounting units has at least two parallel ones of said cylinder and piston units.

5. A combination as defined in claim 4; and means for extending and retracting the cylinder and piston units of each of said mounting units in synchronism.

6. A combination as defined in claim 5, wherein said cylinder and piston units are spring-loaded.

7. A combination as defined in claim 6, wherein said cylinder and piston units each have an upright cylinder connected with the respectively associated mounting unit, a hollow piston open to the interior of the upright cylinder, and spring means biasingly engaging said hollow piston.

8. A combination as defined in claim 1, wherein each of said first rollers has a shaft; and further comprising drive means for driving said shafts in rotation, including a pair of gears each mounted on one of said shafts for rotation with the same, and an input gear meshing with said pair of gears.

9. A combination as defined in claim 8, further comprising squeegee means including a squeegee; mounting means mounting said squeegee for movement; and wherein said drive means cooperates with said squeegee mounting means for effecting the movement of said squeegee.

10. A combination as defined in claim 1, further comprising first and second holding means, each mounted at a fixed location adjacent one of said mounting units and being operative for holding the respectively associated mounting unit against undesired displacement in upright direction relative to the said support.

11. In a screen printing machine, in combination, roller means comprising at least a pair of transversely spaced first guide rollers; means comprising a support and a pair of end mounting units thereon and mounting said first guide rollers for rotation about fixed first axes which are located in a common first plane; a second roller mounted for rotation about a second axis which is normally in a first position wherein it parallels said first axes and which is located in a second plane parallel to said first plane; an endless travelling printing screen band trained about said rollers for entrainment thereby and defining in the space between said first rollers a planar printing run parallel to said planes and having an operating position in which it is juxtaposed with a web to be printed, said band tending at least at times to shift axially of said rollers during entrainment by the same so that said printing run moves out of its operating position; restoring means for moving said band during the travel thereof axially of said rollers in direction counter to the axial shift for restoring said printing run to said operating position thereof, said restoring means comprising a pair of shaft bearings each journally one end of said second roller for rotation, pivot means mounting one of said shaft bearings for pivotal movement about an upright axis, and first adjusting means mounting the other of said shaft bearings for displacement in a path parallel to said planes and transverse to said first axes, for pivoting said second roller and said second axis thereof in said second plane about said upright axis from said first position to a plurality of second positions in each of which said second roller extends skew to said first axes, said first adjusting means including a bearing element supporting said other of said shaft bearings and being displaceable with the same in direction transversely of said second axis, a pair of engaging portions engaging said bearing element at opposite lateral sides of said second axis, and shifting means for shifting said bearing element in direction transversely of said second axis in one or in an opposite direction; and bearing boxes in said end-mounting units and in which said shaft bearings are received; and second adjusting means connected with said bearing boxes annd operative for raising and lowering the same in unison.

12. A combination as defined in claim 11, wherein said second adjusting means comprises a rotatable shaft extending longitudinally of said rollers and carrying in the region of each of said bearing boxes a worm, an upright tapped sleeve mounted beneath and movable with each of said bearing boxes for rotation about an upright axis, a threaded spindle received in each sleeve and having an upper end connected with a respective bearing box, and a worm wheel surrounding and fixedly connected with each of said sleeves and meshing with one of said worms.

13. A combination as defined in claim 12, further comprising guide means for guiding each of said spindles during displacement of the same.

14. A combination as defined in claim 11, and further comprising an antifriction bearing supporting said bearing element for said shifting thereof.

15. A combination as defined in claim 11, wherein said shaft bearings are anti-friction bearings.

16. A combination as defined in claim 11, wherein said shifting means comprises a motor, and a worm drive driven by said motor.

17. A combination as defined in claim 16, wherein said motor is a reversible electromotor.

* * * * *